United States Patent [19]

Herfort et al.

[11] Patent Number: 4,806,119

[45] Date of Patent: Feb. 21, 1989

[54] CUTTING-CLAMPING TERMINAL ELEMENT FOR ELECTRICAL CONDUCTORS

[75] Inventors: Hermann Herfort; Gunter Hegner, both of Berlin, Fed. Rep. of Germany

[73] Assignee: Krone Aktiengesellschaft, Fed. Rep. of Germany

[21] Appl. No.: 118,431

[22] Filed: Nov. 6, 1987

[30] Foreign Application Priority Data

Nov. 6, 1986 [DE] Fed. Rep. of Germany ..... 3637929

[51] Int. Cl.[4] ..... H01R 4/24

[52] U.S. Cl. ..... 439/395; 439/397; 439/402

[58] Field of Search ..... 439/387, 389, 391, 392, 439/395, 396, 397, 398, 399, 400, 401, 402, 403, 404, 405, 408, 435, 443, 888, 874

[56] References Cited

U.S. PATENT DOCUMENTS

| | | | |
|---|---|---|---|
| 2,694,189 | 11/1954 | Wirsching | 439/403 |
| 4,136,920 | 1/1979 | Scholtholt et al. | 439/395 |
| 4,270,831 | 6/1981 | Takahashi | 439/405 |
| 4,421,374 | 12/1983 | Montilla et al. | 439/408 |
| 4,527,852 | 7/1985 | Dechelette | 439/408 |

FOREIGN PATENT DOCUMENTS

| | | | |
|---|---|---|---|
| 2131769 | 12/1972 | Fed. Rep. of Germany | 439/395 |
| 2643112 | 3/1978 | Fed. Rep. of Germany | 439/395 |

*Primary Examiner*—David Pirlot

*Attorney, Agent, or Firm*—McGlew and Tuttle

[57] ABSTRACT

A cutting/clamping terminal element for electrical conductors (14) is disclosed including a clamping slot (0) defined between a clamping piece (4) and an elastic clamping leg (2,3; 23, 13) to ensure an improved contact connection, such that even conductors (14) having very thin conductor core diameters, in particular wire strands, can be connected, without the conductor cross section being reduced and without there being a risk of conductor breakage. For this purpose, the clamping piece (4) is provided with clamping legs (2,3; 12,13) arranged on its front and rear sides, said clamping legs overlapping in the position of rest the clamping piece (4) at least in part, such that the sharp edges (15,24) of the two clamping legs (2,3; 12,13) and of the clamping piece (4) cut into the insulation (11) and clamp the core (10) of the conductor (14) in the clamping slot (9) at in total three different positions.

17 Claims, 5 Drawing Sheets

CUTTING-CLAMPING TERMINAL ELEMENT FOR ELECTRICAL CONDUCTORS

FIELD AND BACKGROUND OF THE INVENTION

The invention relates to a cutting/clamping terminal element for electrical conductors.

German Patent No. 21 42 850 teaches a cutting/-clamping terminal element with two clamping slots. Such a clamping element is limited on the outside by the sharp-edged clamping legs of one elastic metal bracket and on the inside by the edges of a sharp-edged clamping piece. In the resting position i.e., without a conductor being inserted into the clamping slot, the clamping legs rest on the outside against the side edges of the clamping piece being bent off to one side. When pressing a conductor into the clamping slot, the sharp-edged clamping legs and the sharp-edged clamping piece cut the wire insulation of the conductor and penetrate the conductive core of the conductor.

Another cutting/clamping terminal element is known from German Patent No. 82 01195. This cutting/clamping terminal element includes clamping legs bent over along a cross axis and surrounding a bent-off center piece. The cutting edges arranged on the inner side of the clamping legs rest against the side edges of the center piece for forming an open clamping slot.

With known cutting/clamping terminal elements, when pressing the conductor into the clamping slot, the conductor core is notched at two opposed positions whereby the conductor cross section is considerably reduced at the terminal point, such that even the risk of breakage of the conductor core exists. Further, it is not possible with the known terminal elements to connect conductors having a very thin conductor core, as the diameter must always be greater than the slot width of the clamping slot. Therefore, the connection of wire strands would not be possible.

SUMMARY AND OBJECT OF THE INVENTION

The object of the invention is, therefore, to provide a cutting/clamping terminal element where the contact connection between terminal element and conductor core is improved, the risk of reduction of the conductor core cross section and the risk of breakage of the conductor core does not exist, and where conductors having very small core diameters, in particular wire strands, can be connected.

In the cutting/clamping terminal element according to the invention, the cutting edges of the two clamping legs and the clamping piece surrounded by them are not arranged side by side in one plane, but in three planes staggered with respect to each other, whereby the clamping slot does not have an air gap. The cutting edges of the two clamping legs and the clamping piece form, in total, three cutting positions with the conductor and its insulation and in particular with the conductor core. The cutting positions are disposed in three different planes so that a good contact connection between the terminal element and the conductor core exists, for which the conductor core cross section will be reduced only slightly at the terminal position, such that there is no risk of breakage of the conductor core. By means of the cutting/clamping terminal element according to the invention, even conductors having a very thin conductor core diameter, including wire strands, can be connected advantageously. When inserting the conductor that is to be connected into the clamping slot, the two clamping legs are swung away from the clamping piece, and the conductor is centered to the clamping slot by the oblique edges such that the conductor is pressed into the clamping slot between the clamping piece and the two clamping legs. Thus, the sharp edges of the two clamping legs cut at two cutting positions and the sharp edges of the clamping piece cut, at another position, through the insulation of the conductor and contact the conductor core, in total, three times, such that an improved contact connection is achieved. In the resting position, the two clamping legs overlap the clamping piece at a certain angle, such that the cutting/clamping element has no open clamping slot, and all three edges will rest against the conductor without an air gap. In a preferred embodiment, the entire clamping piece is provided with, at both side edges and on its front and rear side, one clamping leg each, this being achieved by a metal bracket on the front and rear side of the clamping piece. Hereby, two clamping slots are formed, each being limited by the entire clamping piece and by two clamping legs. Therefore, even when connecting two conductors, both conductor cores are cut three times. With the sharp edges the clamping piece and the clamping legs being arranged obliquely toward the top and reduction in their distances from each other prevent the conductor from slipping out of the clamping slot.

In order to allow the manufacturing of the cutting/-clamping terminal element in the most economical manner, the metal brackets arranged on the front and rear side can be formed as one piece from a metal double bracket. It is manufactured as a stamped part, provided centrally with two V-shaped cuts, their tips directed away from each other. Centrally, with respect to the central cross axis of the stamped part, the two metal brackets are bent in 180° angle toward each other.

Accordingly, a cutting/clamping terminal element is provided for cutting and clamping an electrical conductor having a core and having insulation. The terminal element advantageously includes a front U-shape member and a rear U-shaped member. A clamping piece is connected to each of the front U-shaped member and the rear U-shaped member at a base portion. The upper portion of the clamping piece has a first sharp cutting/-clamping edge and a second sharp cutting/clamping edge. In a rest position, the sharp edges of the clamping piece are overlapped by the various leg portions of the U-shaped members. The connection at the base portion is made so that the clamping piece may be moved in either the direction toward the first front and back leg members or in the direction towards the second front and back leg members. By moving the clamping piece towards the second front and back leg members, a clamping slot is formed between the first sharp edge of the clamping piece and the edge of the first rear end front clamping legs. Similarly, by moving the clamping piece toward the first front and rear leg members, a slot is formed between the second sharp clamping edge of the clamping piece and the second front and rear edges of the clamping legs. When the clamping piece is moved in either direction, the clamping piece, by the connection at the base member, is urged to move back into a rest position. Thus, a conductor positioned within the clamping slot will encounter the sharp edges of the clamping legs and the clamping piece such that the clamping legs and clamping piece will cut into the insulation and contact the core of the conductor at three cutting positions. The force acting on the conductor is due to the force urging the clamping piece back into its rest position. In its clamping position, the clamping slot is defined by the sharp edge of the clamping piece and the sharp edges of the front and rear legs (either first front rear legs or second front rear legs). These edge portions, in the clamping position, are tapered such that the clamping slot has a width which increased from an upper portion of the clamping slot to a lower portion of the clamping slot.

It is a further object of the present invention to provide a cutting/clamping terminal element which is simple in design, rugged in construction and economical to manufacture.

The various features of novelty which characterize the invention are pointed with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENT

Figure 1:
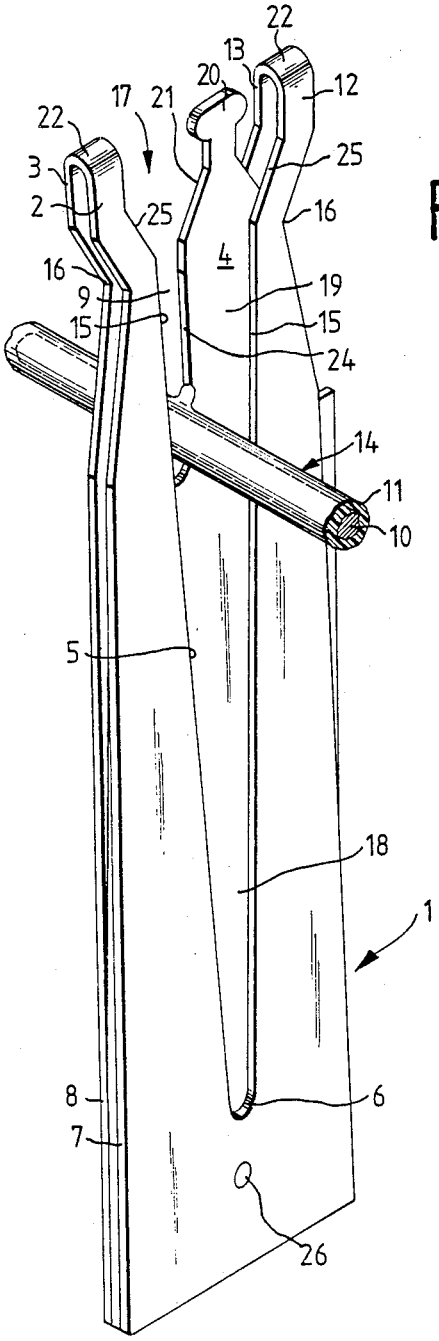
FIG. 1 is a perspective view of the cutting/clamping element according to the invention with connected conductor.
Figure 2:
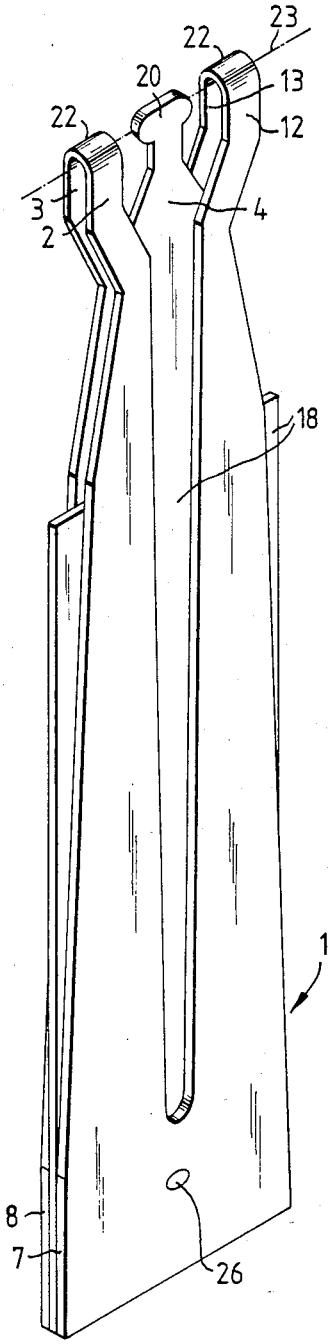
FIG. 2 is a perspective view of the cutting-clamping element according to the invention.
Figure 3:
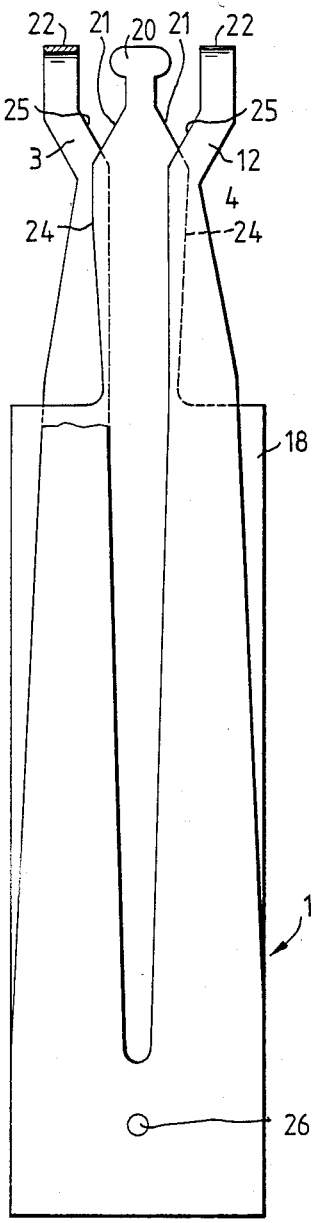
FIG. 3 is a front view of the cutting/clamping element according to the invention.
Figure 5:
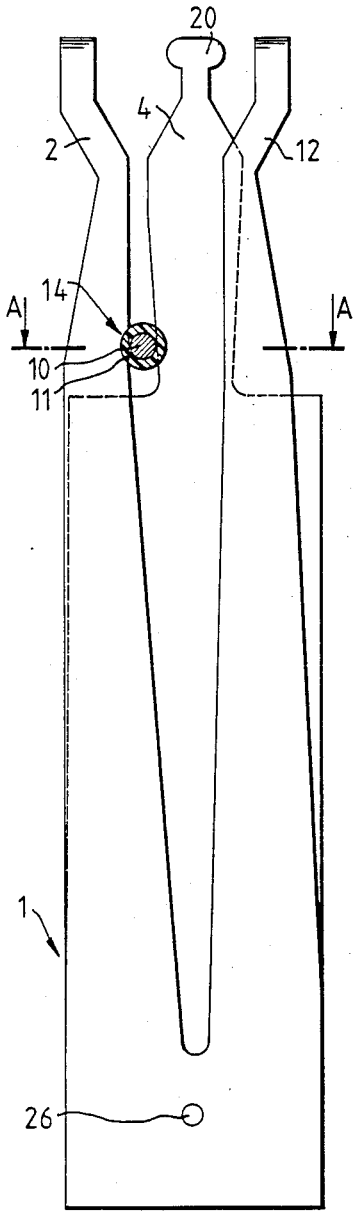
FIG. 5 is a front view of the cutting/clamping element according to the invention.
Figure 4:
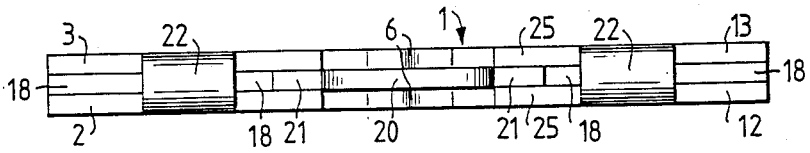
FIG. 4 is an enlarged plan view of the cutting/clamping element according to FIG. 3.
Figure 6:
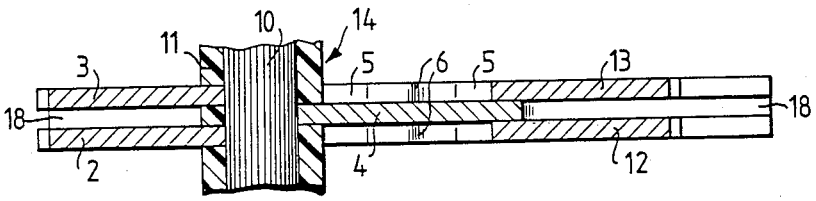
FIG. 6 is an enlarged sectional view of the cutting/-clamping element according to the invention.
Figure 9:
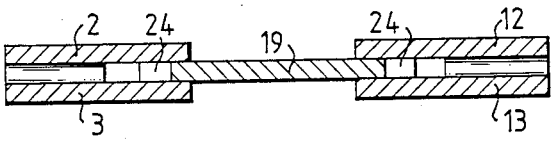
FIG. 9 is an enlarged sectional representation of the cutting-clamping element according to the invention along line B—B of FIG. 7.
Figure 7:
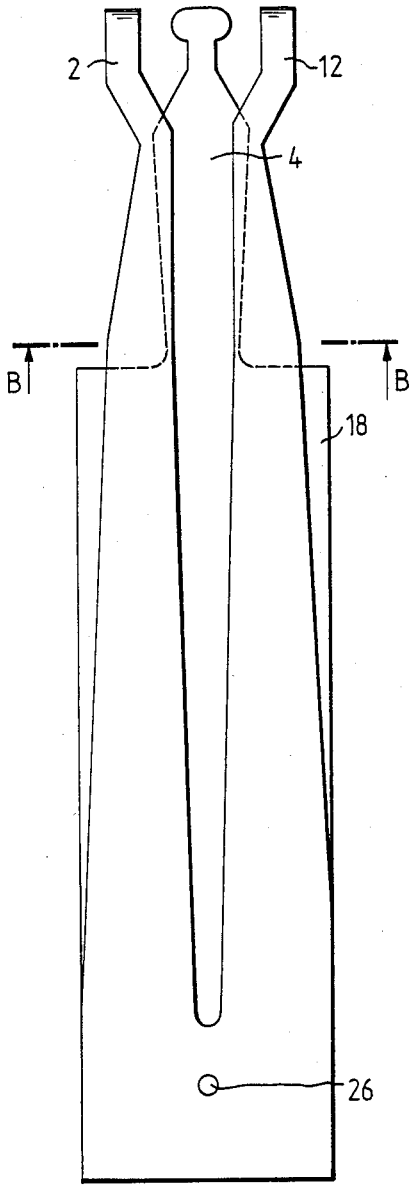
FIG. 7 is a front view of the complete cutting/clamping terminal element according to the invention.
Figure 8:
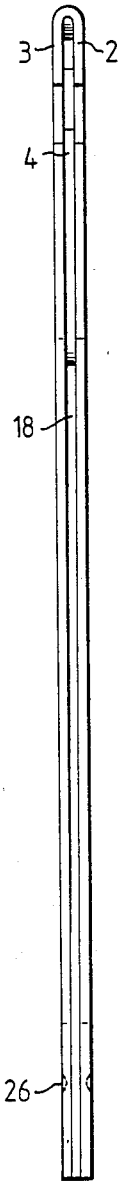
FIG. 8 is a side view of the cutting/clamping element according to FIG. 7.

The cutting/clamping terminal element consists of a clamping piece 4 arranged at a rectangular basic body 18 and of a metal double bracket 1, being designed as a stamped part made from an electrically conductive metal material. The clamping piece 4 bears a central extension 91 directed upward exhibiting on both sides sharp edges 24. At the upper end of the extension 19,an oval cable protection 20 is arranged, upon which follows an oblique, sharp edge 21 on both sides.

On the front and rear side of the clamping piece 4 and its basic body 18, one-piece metal brackets 7 and 8 are each arranged forming the metal double bracket 1. The metal double bracket 1 is designed in its developed projection as basically a rectangular thin plate with two interior opposed V-shaped cuts 5, the vertices 6 being directed away from each other. Along a central cross axis 23, the two metal brackets 7, 8 of the metal double bracket 1 are bent over by 90° toward each other at bending positions 22. The two metal brackets 7, 8 rest against the front or rear side, respectively, of the clamping piece 4 with small lateral clearance. The clamping piece 4 is, thus, guided between the two metal brackets 7, 8. The metal double bracket 1 and the basic body 18 of the clamping piece 4 are conductively connected to each other at the bottom below the vertex 6 of the V-shaped cut over a spot-welded connection 26.

The metal bracket 7 arranged on the front side exhibits two clamping legs 2, 12, and the metal bracket 8 arranged on the rear side of the clamping piece 4 exhibits two clamping legs 3, 13. The inner edges of the clamping legs 2, 3, 12, 13 directed to the sharp edges 24 of the clamping piece 4 are, also, designed as sharp edges 15. Above these sharp edges 15, oblique, sharp edges 25 are provided, being opposed to the oblique, sharp edges 21 of the clamping piece 4.

For connecting a conductor 14, it is first inserted in an inlet opening 17 disposed above the oblique, sharp edges 21, 25. The conductor 14 is fixed in this position by the cable protection 10 against slipping-out. By means of a not-shown tool, the conductor 14 is now pressed into the clamping slot 9 formed between the sharp edges 15 and 24.

The oblique, sharp edges 21 and 24 are directed toward each other so the clamping piece 4 or of the clamping legs 2, 3, 12, 13, respectively, center the conductor 24 and cut the insulation 11 of the conductor 14 at three positions. The clamping legs 2, 3 or 12, 13, respectively, are swung out in spring-type manner. The conductor 14 is now inserted into the clamping sot 9. Here, the conductor core 10 is contacted three times by the sharp edges 24 of the clamping piece 4. The clamping slot 9 is limited by the sharp edges 15, 24 which is not parallel, but formed in reducing width toward the top in the direction of the cable protection 20, such that the conductor 14 is fixed in the clamping slot 9 and preventing from slipping out. Thus, even vibrations will not loosen the clamping construction. An additional fixation (support) for the contacting conductor is not required.

The outer edges of the clamping legs 2, 3; 12, 13 are provided in the area of the transition between the sharp inner edges 25 and 15. The blunt-cornered V-shaped cuts 16 are advantageously provided so as to allow for a better force distribution from the conductor 14 to the terminal element.

In a further embodiment (not shown), the terminal element consists of the clamping piece and of two individual metal brackets being in contrast to the first embodiment not formed by a one-piece metal double bracket. The connection of the two metal brackets with the clamping piece is performed at the lower end of the terminal element over a spot-welded connection, and at the upper end over connection elements, which can be formed also by spot-welded connections, with spacer parts interposed between the two metal brackets.

While a specific embodiment of the invention has been shown and described in detail to illustrate the application of the principals of the invention, it will be understood that the invention may be embodied otherwise without departing from such principals.

What is claimed is:

1. A cutting/clamping terminal element for an electrical conductor, the conductor having a core and having insulation comprising: a clamping piece having a base portion and an upper portion with a first sharp cutting/-clamping edge and a second sharp cutting/clamping edge; a front U-shaped clamping member including a first front clamping leg and a second front clamping leg, each of said front clamping legs having an upper portion with a sharp cutting/clamping edge, said front U-shaped member having a base portion connected to the base portion of said clamping piece; and, a rear U-shaped clamping member including a first rear clamping leg and a second rear clamping leg, each of said clamping legs having an upper portion with a sharp cutting/clamping edge, said rear U-shaped clamping member including a base portion connected to the base portion of said clamping piece, the sharp edge of said front clamping legs lying in a front cutting plane, the sharp edge of said rear clamping legs lying in a rear cutting plane, said first and second clamping piece sharp edges laying in a central cutting plane, the clamping piece upper portion being movable with respect to said first front and rear clamping legs and said second front and rear clamping legs from a clamping piece rest position to define a clamping slot region between one of said first clamping piece edge and said first front and rear clamping legs and said second clamping piece edge and said second front and rear clamping legs, a conductor being positionable within said clamping slot so the edges of said clamping legs and said clamping piece cut into the insulation and contact the core of the conductor at three cutting positions.

2. A cutting/clamping terminal element according to claim 1, wherein: the front first and second clamping legs and the rear first and second clamping legs overlap at least part of the clamping piece in the clamping piece rest position.

3. A cutting/clamping terminal element according to claim 1, wherein: said clamping slot is limited by the sharp edges of one of the first clamping piece edge and the first front and rear clamping leg edges and the second clamping piece edge and the second front and rear clamping leg edges, the width of the clamping slot reducing in the direction of the inlet opening when the conductor core is in a clamped position.

4. A cutting/clamping terminal element according to claim 1, wherein: said front U-shaped member is an integrally formed U-shaped metal bracket and said rear U-shaped member is an integrally formed rear U-shaped metal bracket.

5. A cutting/clamping terminal element according to claim 4, wherein: the front metal bracket, the rear metal bracket and the clamping piece are connected conductively to each other at a base portion over a spot-welded connection.

6. A cutting/clamping terminal element according to claim 4, wherein: the front metal bracket and the rear metal bracket are connected to each other at an upper portion of the respective clamping legs by a connecting member.

7. A cutting/clamping terminal element according to claim 4, wherein: said front metal bracket and said rear metal bracket are a one-piece metal double bracket.

8. A cutting/clamping terminal element according to claim 7, wherein: said metal double bracket is formed of a stamped part which is bent along a central cross axis by 180°.

9. A cutting, clamping terminal element for an electrical conductor, the conductor having a core and having insulation, comprising: a clamping piece having a base portion and an upper portion with a first sharp cutting/clamping edge; two first clamping legs each first clamping leg having a base portion and an upper portion with a sharp cutting/clamping edge, said base portion of each of said first clamping legs being connected to said clamping piece base portion, the clamping piece upper portion having a rest position and being movable with respect to said leg portions to define a clamping slot region between said two clamping leg edges and said clamping piece first sharp edge; a conductor being positionable within said clamping slot so the sharp edge of said clamping legs and said clamping piece cut into insulation and contact the core of the conductor at three cutting positions; a clamping piece second sharp/cutting clamping edge; two second clamping legs, each second clamping leg having an upper portion with a sharp cutting/clamping edge and having a base portion, the base portion of a front one of said two first clamping legs being connected to the base portion of a front one of said two second clamping legs to form a substantially U-shaped front member, the base portion of a rear one of said two first clamping legs being connected to the base portion of a rear one of said two second clamping legs to form a substantially U-shaped rear member.

10. A cutting/clamping terminal element according to claim 9, wherein: the first clamping legs are positioned on the front and rear sides of the clamping piece first sharp edge and the second clamping legs positioned on the front and rear side of the clamping piece second sharp edge.

11. A cutting/clamping terminal element according to claim 9, wherein: the first and second leg of the front U-shaped member are formed integral of a U-shaped metal bracket and the first and second leg of the rear U-shaped member are formed integral of a U-shaped metal bracket.

12. A cutting/clamping terminal element according to claim 11, wherein the first U-shaped metal bracket, the second U-shaped metal bracket and the clamping piece are connected conductively to each other at the base portion by a spot-welded connection.

13. A cutting/clamping terminal element according to claim 11, wherein the first and second U-shaped metal brackets are connected to each other at an upper end of first and second clamping legs by a connecting member.

14. A cutting/clamping terminal element according to claim 11, wherein the front and rear metal brackets are formed integral as a one piece metal double bracket.

15. A cutting/clamping terminal element according to claim 14, wherein the metal double bracket is formed of a stamped part which is bent at a central location by 180° along a central cross axis.

16. A cutting, clamping terminal element for an electrical conductor, the conductor having a core and having insulation, comprising: a clamping piece having a base portion and an upper portion with a first sharp cutting/clamping edge; two first clamping legs each first clamping leg having a base portion and an upper portion with a sharp cutting/clamping edge, said base portion of each of said first clamping legs being connected to said clamping piece base portion, the clamping piece upper portion having a rest position and being movable with respect to said leg portions to define a clamping slot region between said two clamping leg edges and said clamping piece first sharp edge, a conductor being positionable within said clamping slot so the sharp edge of said clamping legs and said clamping piece cut into insulation and contact the core of the conductor at three cutting positions; a clamping piece second sharp/cutting clamping edge; two second clamping legs, each second clamping leg having an upper portion with a sharp cutting/clamping edge and having a base portion, the base portion of a front one of said two first clamping legs being connected to the base portion of a front one of said two second clamping legs to form a substantially U-shaped front member, the base portion of a rear one of said two first clamping legs being connected to the base portion of a rear one of said two second clamping legs to form a substantially U-shaped rear member; said clamping legs of said front member and said clamping legs of said rear member overlaping a portion of the clamping piece in the clamping piece rest position.

17. A cutting, clamping terminal element for an electrical conductor, the conductor having a core and having insulation, comprising: a clamping piece having a base portion and an upper portion with a first sharp cutting/clamping edge; two first clamping legs each first clamping leg having a base portion and an upper portion with a sharp cutting/clamping edge, said base portion of each of said first clamping legs being connected to said clamping piece base portion, the clamping piece upper portion having a rest position and being movable with respect to said leg portions to define a clamping slot region between said two clamping leg edges and said clamping piece first sharp edge; a conductor being positionable within said clamping slot so the sharp edge of said clamping legs and said clamping piece cut into insulation and contact the core of the conductor at three cutting positions, the clamping slot being limited by the sharp edges which define a reducing width in the direction of an inlet opening when a conductor core is in a clamped position.

* * * * *